US011060293B2

(12) United States Patent
Graves

(10) Patent No.: US 11,060,293 B2
(45) Date of Patent: Jul. 13, 2021

(54) RAIN GUTTER COVER ASSEMBLY

(71) Applicant: Steven Graves, Caledon (CA)

(72) Inventor: Steven Graves, Caledon (CA)

( * ) Notice: Subject to any disclaimer, the term of this patent is extended or adjusted under 35 U.S.C. 154(b) by 0 days.

(21) Appl. No.: 16/540,387

(22) Filed: Aug. 14, 2019

(65) Prior Publication Data

US 2020/0217074 A1 Jul. 9, 2020

Related U.S. Application Data

(63) Continuation-in-part of application No. 29/676,184, filed on Jan. 9, 2019.

(30) Foreign Application Priority Data

Jun. 5, 2019 (CA) ..... CA 3045555

(51) Int. Cl.
*E04D 13/076* (2006.01)

(52) U.S. Cl.
CPC ..... *E04D 13/076* (2013.01)

(58) Field of Classification Search
CPC . E04D 13/076; E04D 13/0725; E04D 13/064; E04D 13/00; E04D 13/068
See application file for complete search history.

(56) References Cited

U.S. PATENT DOCUMENTS

| | | | | |
|---|---|---|---|---|
| 4,907,381 | A * | 3/1990 | Ealer | E04D 13/076 52/12 |
| 6,786,008 | B2 | 4/2004 | Brochu | |
| 7,908,797 | B2 | 3/2011 | Graves | |
| 8,322,082 | B2 | 12/2012 | Neumann | |
| 8,695,282 | B2 | 4/2014 | Glander | |
| 9,127,463 | B1 * | 9/2015 | Feldhaus | E04D 13/0725 |
| 9,163,406 | B1 * | 10/2015 | Ealer, Sr. | E04D 13/076 |
| 9,631,369 | B2 * | 4/2017 | Cullen | E04D 13/068 |
| 10,519,667 | B1 * | 12/2019 | Ealer, Sr. | B21D 31/04 |
| 2002/0166290 | A1 * | 11/2002 | Bergeron | E04D 13/076 52/12 |
| 2006/0053697 | A1 * | 3/2006 | Higginbotham | E04D 13/076 52/12 |
| 2011/0185641 | A1 * | 8/2011 | Snell | E04D 13/076 52/12 |

* cited by examiner

*Primary Examiner* — Brian E Glessner
*Assistant Examiner* — Daniel J Kenny

(57) ABSTRACT

A gutter cover for a rain gutter includes a U-shaped rear portion, a forward edge portion, and a perforated horizontal central portion spanning between the rear and forward edge portions. The forward edge portion includes a web extending upwardly from the central portion, and a covering flange and downward hooked edge portion extending forwardly from the web. The hooked edge portion having an end positioned for engagement with the underside of a front lip of the gutter.

27 Claims, 9 Drawing Sheets

RAIN GUTTER COVER ASSEMBLY

RELATED APPLICATIONS

This application is a continuation-in-part of U.S. patent application Ser. No. 29/676,184, filed Jan. 9, 2019.

SCOPE OF THE INVENTION

The present invention relates to a rain gutter cover for reducing or preventing the accumulation of leaves, sticks and other debris within a rain gutter trough, and more preferably a rain gutter cover which is configured to engage a forward lip of the gutter trough in an interlocking configuration.

BACKGROUND OF THE INVENTION

The use of eavestrough or rain gutter systems on buildings is well known. Conventional eavestrough systems typically include an upwardly open U-shaped eavestrough or rain gutter which is positioned along the building eaves to collect and divert rainwater runoff from the building roof to a vertically extending downspout.

The accumulation of leaves, twigs and other debris within the rain gutter presents a maintenance challenge. Such debris not only impedes the flow of collected water longitudinally along the length of the eavestrough, but may further result in blockage of downspouts, interfering with the movement of collected water away from building. The accumulation of water, ice and snow within the gutter trough may result in increased loading, leading to gutter trough deformation, or in extreme cases, failure.

Various rain gutter assemblies have been proposed which incorporate a gutter shield or cover adapted to prevent the collection of leaves and debris within the interior of the gutter trough. U.S. Pat. No. 7,686,008 to Brochu, the contents of which are incorporated herein by reference in its entirety, describes a gutter cover which is formed having a perforated planar central portion, and which includes along one side edge, an upwardly curving portion. The upwardly curving edge portion is configured to fit within a recess formed in a forward upper edge of a K-style gutter trough. The second rear edge of the gutter cover is formed having an inverted U-shape, sized to fit over the rear wall of the gutter. U.S. Pat. No. 8,322,082 B2 to Neumann, the contents of which are incorporated herein by reference in its entirety, describes a gutter cover front formed as a snap-in hanger attachment. The gutter cover is provided with multiple sieved or perforated horizontal surfaces separated by longitudinal projections. U.S. Pat. No. 8,695,282 B2 to Glander, the entirety of which is incorporated herein by reference, describes a gutter cover or guard for use with a K-style rain gutter. The gutter cover includes at a forward end, an L-shaped front flange sized for positioning within the recess defined by a lip of the gutter front edge.

The applicant has appreciated that conventional gutter cover arrangements suffer a disadvantage in that the forward edge portion of the gutter cover is typically mounted in an arrangement extending beneath the front gutter lip. This in turn may result in a channel or pocket between the front lip of the gutter and the gutter cover in which leaves, twigs and other debris may collect.

SUMMARY OF THE INVENTION

The present invention seeks to provide a gutter guard or cover for use in combination with an eavestrough or rain gutter, and most preferably a K-style rain gutter, and which is adapted to restrict or minimize the collection of leaves, twigs and other debris within the gutter trough interior, whilst facilitating the shedding of any debris which may be collected thereon outwardly, from the gutter assembly.

Most preferably, the gutter cover is formed with a forward edge portion which is adapted to engage the outer forward lip of a K-style eavestrough or rain gutter in a mechanical interlocking arrangement and which facilitates the securement and positioning of the rain gutter in place against a building facia.

Accordingly, in one aspect the present invention resides in a gutter cover for use with a K-style rain gutter having a generally vertical rear gutter wall, substantially horizontal front gutter-flange portion spaced forwardly from said rear gutter wall, and a gutter lip extending forwardly downward from a rear of the horizontal front gutter-flange portion to define a channel there between, the gutter cover comprising, a generally U-shaped rear portion adapted for fitted placement over an upper edge portion of the rear gutter wall, the U-shaped rear portion including a vertically extending planar rear member and a front member spaced forwardly from the rear member and joined thereto along an uppermost bight, a forward edge portion, a perforated generally horizontal central portion spanning between said rear portion and said forward edge portion, and wherein the forward edge portion includes, a web extending upwardly from the central portion to a web upper edge, a covering flange extending horizontally forward from the web upper edge, and a hooked edge portion extending downwardly and forwardly from the web or the covering flange, the hooked edge portion having a hooked end adapted for engaging contact with the gutter lip, the cover flange being sized for at least partial juxtaposed placement over at least part of the front gutter-flange portion when said hooked end is position in mechanical engagement with the gutter lip.

In another aspect, the present invention resides in a gutter cover for use with a gutter trough having a trough rear gutter wall and trough front wall having a horizontal front gutter-flange portion and a gutter lip extending forwardly downward from a rear portion of the front gutter-flange portion to define a gutter end channel there between, the gutter cover comprising, a generally U-shaped rear portion adapted for fitted placement over an upper edge portion of the rear gutter wall, the U-shaped rear edge portion includes a rear member and a front member disposed forwardly from the rear member and joined thereto along an uppermost bight, a forward edge portion, a perforated generally horizontal central portion spanning between said rear portion and said forward portion, and wherein the forward edge portion includes, a web extending upwardly from the central portion to a web upper edge, a covering flange extending substantially horizontally forward from the web upper edge, and a hooked edge portion extending downwardly and forwardly from the flange, the hooked edge portion having a hooked end sized for positioning at least partially within the gutter end channel, when the covering flange is positioned in least partial juxtaposed placement over at least part of the front gutter-flange portion.

In a further aspect the present aspect resides in combination, a rain gutter trough and a gutter cover, the gutter trough having a laterally extending trough bottom, and spaced apart front and rear gutter walls projecting upwardly from opposing edge portions of said trough bottom, the front gutter wall including a generally horizontal upper flange portion, and a gutter lip extending forwardly downward from a rear edge of the upper flange portion to define a channel there between, the improvement wherein the gutter cover comprises, a generally U-shaped rear portion overlying an upper edge portion of the rear gutter wall, the U-shaped rear portion including a generally planar rear member and a front member disposed forwardly from the rear member and joined thereto along an uppermost bight, a forward edge portion, a perforated generally horizontal central portion extending laterally above the trough bottom from said rear portion to said forward edge portion, wherein the forward edge portion includes, an inclined web portion extending angularly upwardly from the central portion to a web upper edge at an inclination angle selected at between about 30° and 70°, preferably 40° and 60°, and most preferably 45° to 50°, a cover flange extending forwardly from the web upper edge, and a hooked lip portion projecting downwardly and forwardly below at least part of the cover flange, the hooked lip portion having a size and orientation selected for complementary mechanical engagement with the gutter lip, where the cover flange is moved into juxtaposed placement over at least part of the front gutter-flange portion.

BRIEF DESCRIPTION OF THE DRAWINGS

Reference may now be had to the following detailed description, taken together with the accompanying drawings in which.

DETAILED DESCRIPTION OF THE PREFERRED EMBODIMENTS

Figure 1:
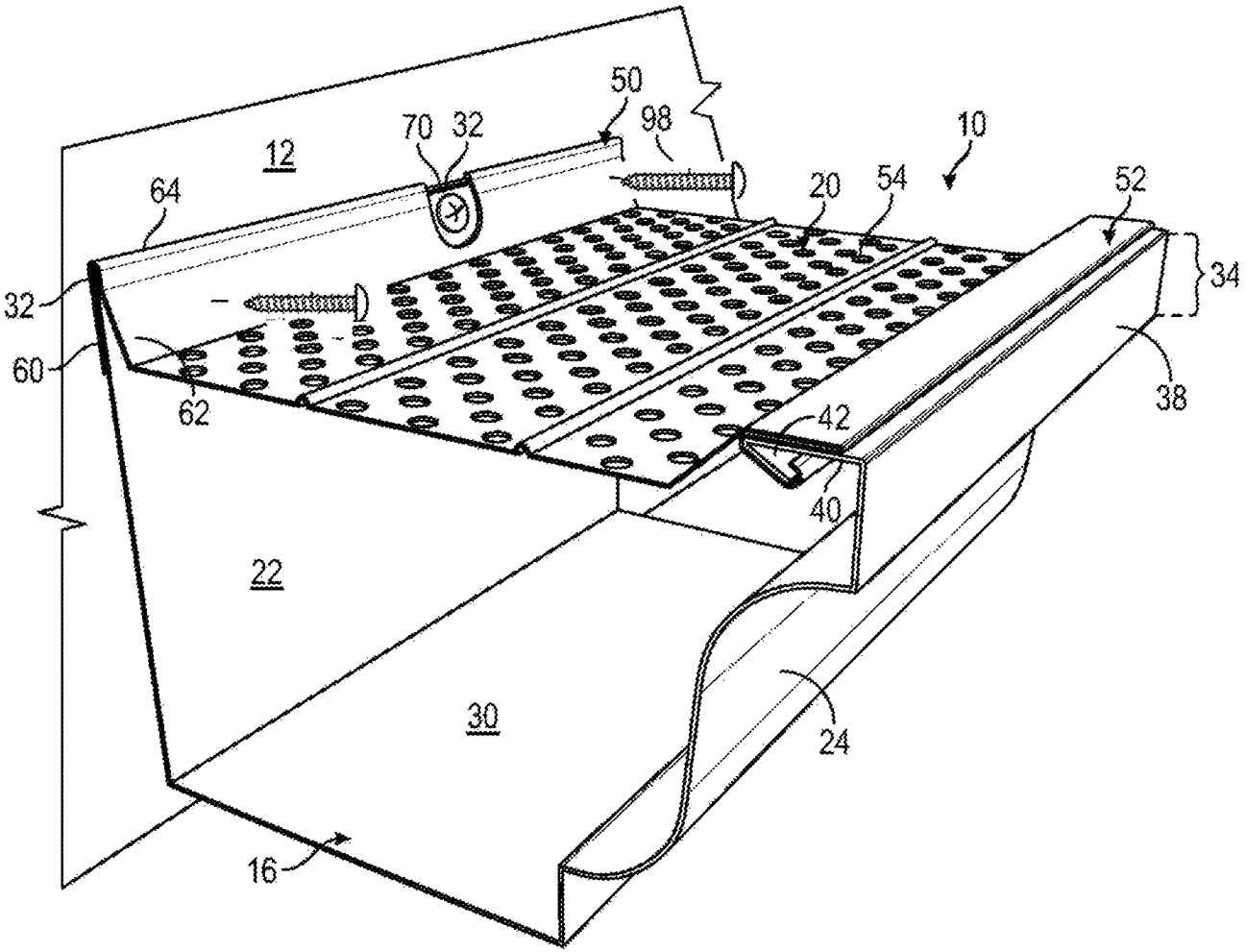
FIG. 1 illustrates a partial cut away perspective view of a rain gutter assembly partially mounted to a building facia board in accordance with a first embodiment of the invention.

Reference may be had to FIG. 1 which illustrates a cut-away perspective view of a rain gutter assembly 10 for securement to a building facia board 12 in the collection and diversion of rain water runoff. The rain gutter assembly 10 includes a K-style rain gutter 16 and rain gutter cover 20. Each of the rain gutter 16 and rain gutter cover 20 are roll formed from an aluminum sheet with a longitudinal length extending along the building facia board 12, and a lateral width $W_L$ projecting forwardly outward therefrom, a distance selected to collect runoff from the building roof (not shown), and which in conventional residential applications, is typically selected at between about 3 and 6 inches.

Figure 2:
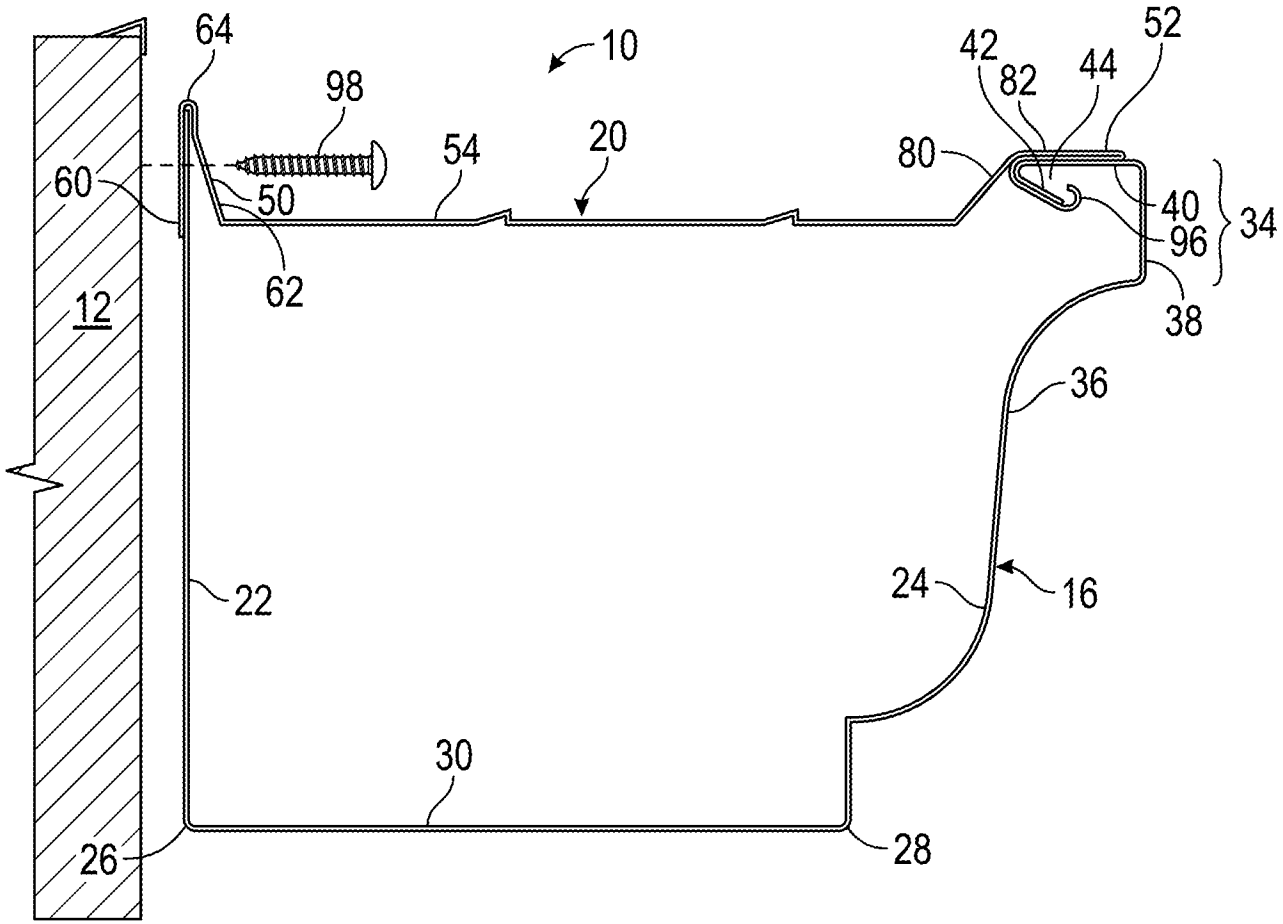
FIG. 2 illustrates a partially exploded cross-sectional view of the rain gutter assembly shown in FIG. 1.

FIG. 2 illustrates the K-style rain gutter 16 as being of a conventional design with the gutter cover 20 in a position mounted thereto. The rain gutter 16 includes laterally spaced rear and front walls 22, 24 which are integrally joined at their respective bottom edges 26, 28 by a laterally horizontal oriented trough bottom 30.

The rear wall 22 is provided with a generally planar construction for juxtaposed placement against the facia board 12 and extends vertically from the bottom edge 26 to an upper most top edge 32. The front wall 24 is shown best in FIG. 2 as extending upwardly from the bottom edge 28 to horizontal forward upper lip portion 34. As shown best in FIG. 2, the front wall 24 may optionally be provided with an ogee shape or other contoured outer facing surface portion 36 depending on the aesthetic to be achieved. The upper lip portion 34 is shown as including a front vertical flange portion 38, a generally horizontal flange portion 40 which extends perpendicularly rearward from the upper edge of the front vertical flange portion 38, and an inner gutter lip 42. The inner gutter lip 42 projects angularly forward and downward from the rearward-most edge of the horizontal flange portion 40 at an angle of between about 20° and 800, preferably 40° to 60°. The gutter lip 42 defines a V-shaped channel 44 between the gutter lip 42 and the overlying portion of the horizontal flange portion 40.

Figure 3:
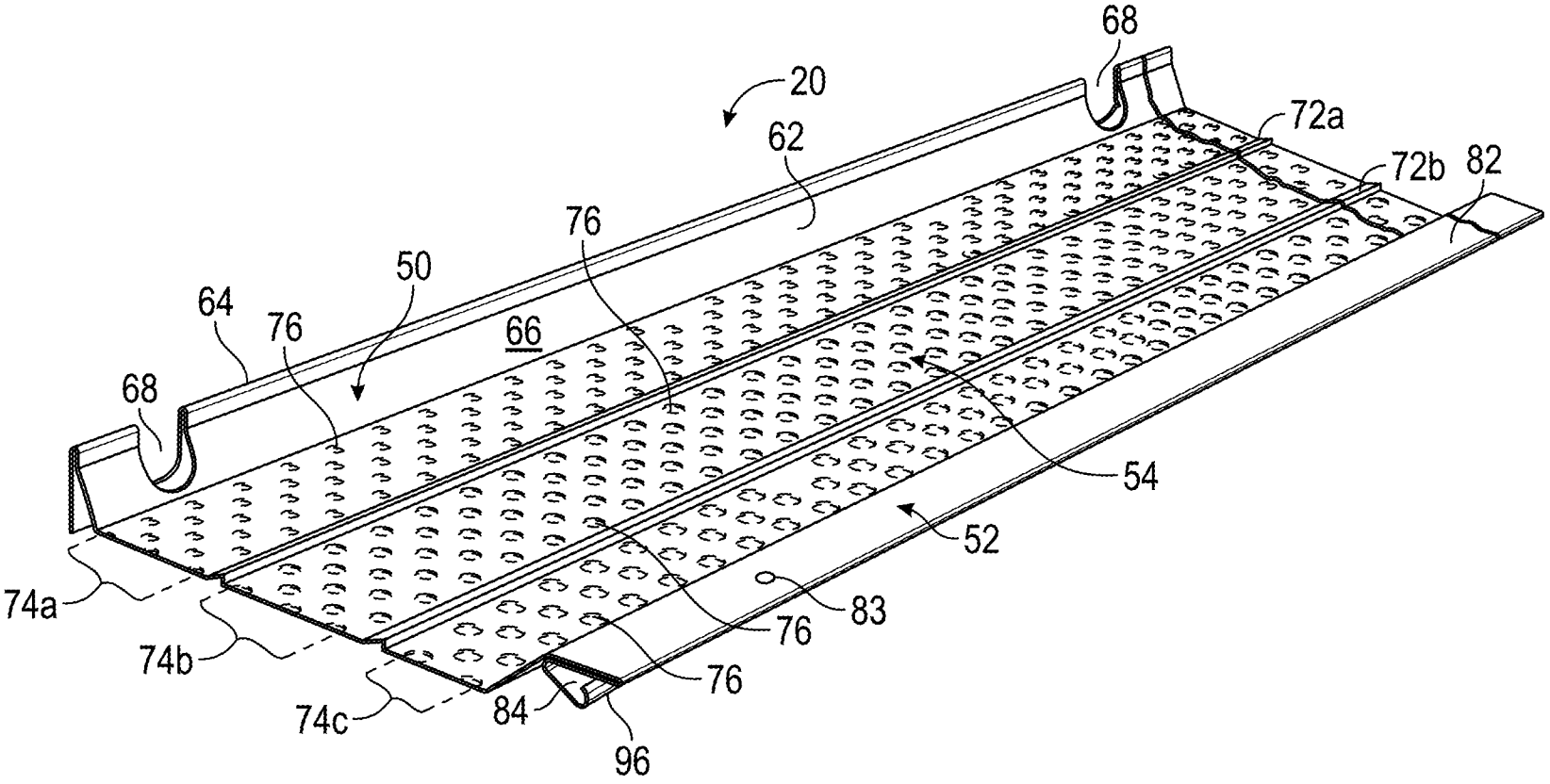
FIG. 3 illustrates a perspective, front and top view of the rain gutter cover used in the rain gutter assembly shown in FIG. 1.
Figure 4:
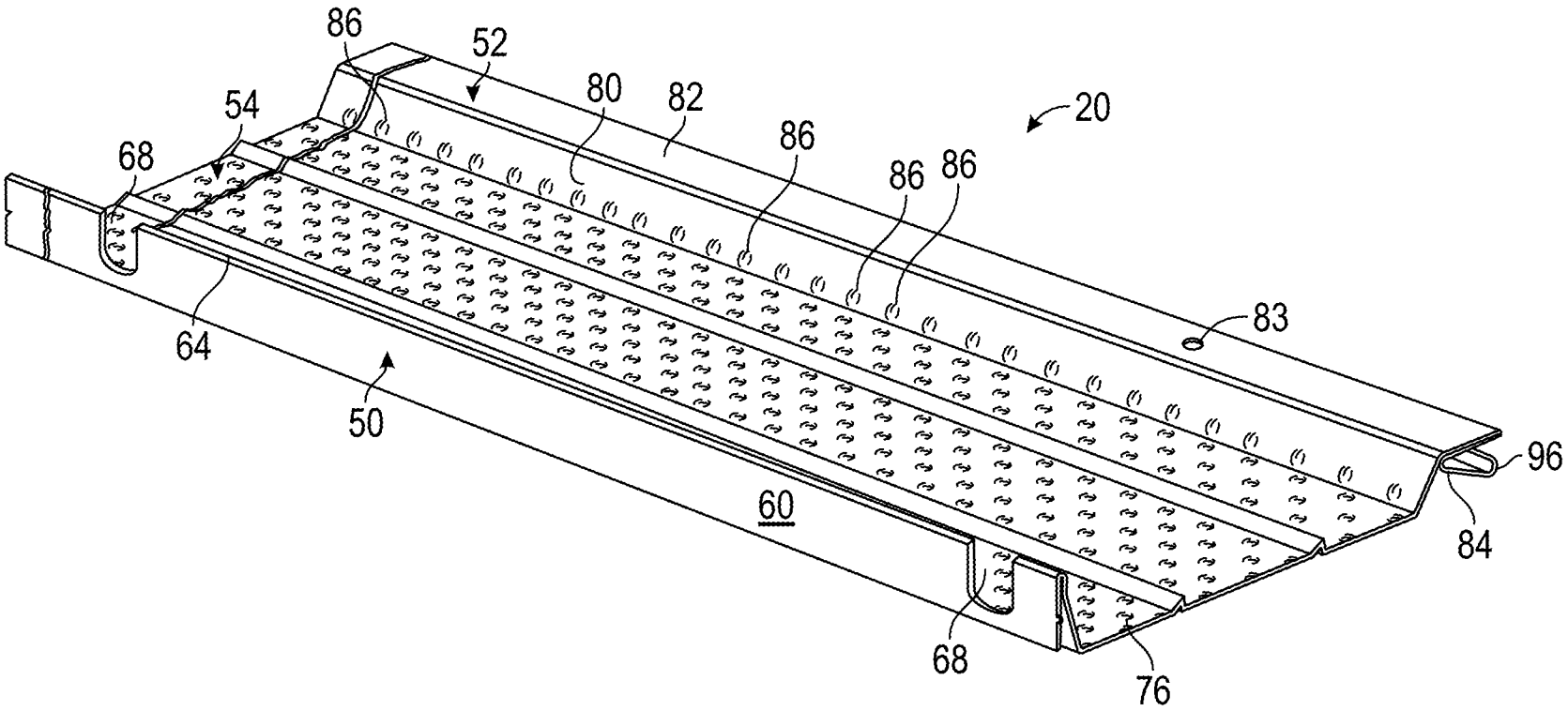
FIG. 4 illustrates a perspective, top and rear view of the rain gutter cover shown in FIG. 3.

Reference may be had to FIGS. 3 and 4 which illustrate best the rain gutter cover 20 used in the rain gutter assembly 10 shown in FIG. 1. The gutter cover 20 includes a deformable rear portion 50 which, as will be described is adapted for fitted placement over the top edge 32 of the gutter rear wall 22, a forward edge portion 52, and a generally horizontal central portion 54 which spans between and integrally joins with the rear portion 50 and forward edge portion 52.

Figure 5A:
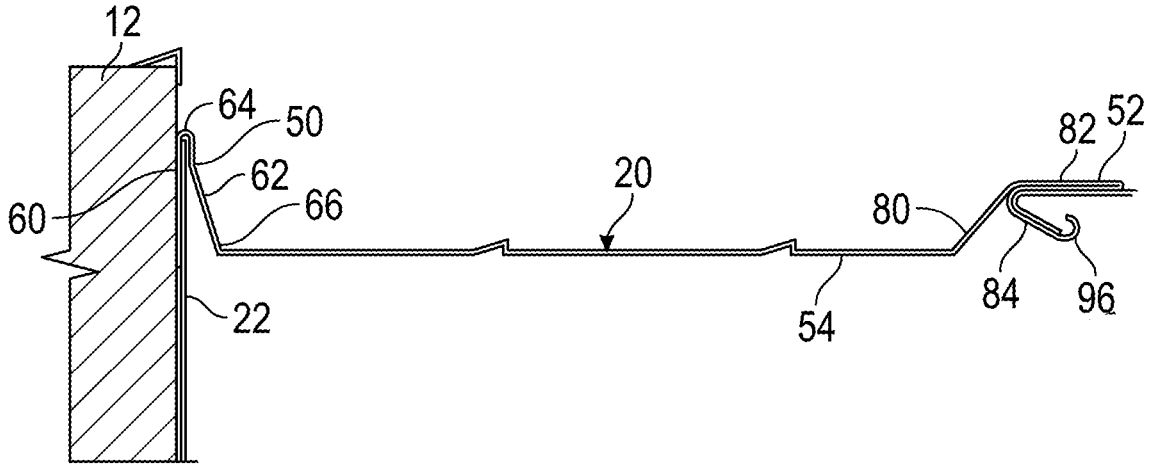
FIGS. 5A and 5B illustrate partial cross-sectional views showing the securement of the rain gutter cover of FIG. 3 to the building facia board.
Figure 5B:
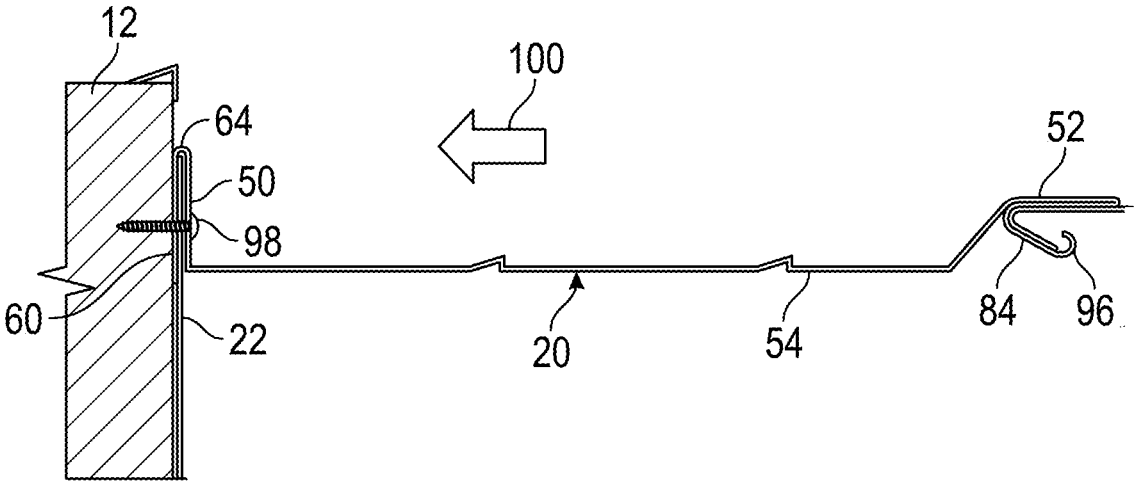

The rear portion 50 is shown best in FIGS. 2, 5A and 5B as having a generally inverted downwardly open U-shape. The rear portion 50 includes a generally planar vertical rear web 60 which is joined with a front web 62 along an uppermost bight 64. FIG. 5A shows best the rear web 60 as being sized for placement interposed between the facia board 12 and the rear wall 22, with the top edge 32 of the rain gutter 16 substantially seated within the bight 64. The front web 62 includes a forwardly bent lower portion 66 which extends angularly away from the rear web 60 towards the forward edge portion 52, merging at its lower edge with the central portion 54. As will be described, the forwardly bent portion 66 preferably extends angularly away from the rear web 60 at an angle between about 30° and 60°, preferably 40° and 50°, and which is selected to allow for the deformation of the rear portion 50 with the portion 66 and central portion 54 moving rearwardly towards a substantially collapsed orientation against the facia board 12 during the positioning and mounting of the gutter cover 20.

FIGS. 1 and 3 illustrate best a series of optional cut-outs 68 being formed into the rear portion 50 downwardly through the upper bight 64 and partway through the rear and front webs 60, 62. As shown in FIG. 1, the cut outs 68 allow for the positioning of the rain gutter cover 20 over a rain gutter 16 and its mounting against a building facia by way of anchor screws 70 in a conventional manner. In particular, the cut outs 68 allow for the mounting of the rain gutter 16 using conventional rain gutter mounting screws or other hardware 70, without interference or obstruction by the added thickness of the gutter cover 20.

FIG. 3 illustrates the central portion 54 as being formed from a single sheet of aluminum with both the rear portion 50 and forward edge portion 52. The central portion 54 preferably includes one or more longitudinally extending reinforcing ribs 72*a*, 72*b*. The reinforcing ribs 72*a*. 72*b* are provided with a profile selected to both reduce sagging of the gutter cover 20 in the longitudinal direction, whilst allowing lateral flexure of the central portion 54 to facilitate the positioning of the cover 20 over the rain gutter 16. The reinforcing ribs 72 are further formed with a vertical profile selected so as to substantially not interfere with the deflection or movement of the debris which may accumulate on top of the gutter cover 20 outwardly and off of the gutter assembly 10. Each of the reinforcing ribs 72*a*, 72*b* delineate three separate arrays of apertures 74*a*, 74*b*. 74*c*. Each aperture array 74*a*, 74*b*, 74*c* consists of a number of circular apertures 76 formed through the central portion. The apertures 76 preferably have an average diameter selected at between about 1 and 5 mm, preferably about 1 to 2 mm to permit the substantially unimpeded movement of water runoff through the cover 20 and into the rain gutter 16, whilst preventing leaves, twigs and other debris from passing therethrough. The individual apertures 76 are separated from adjacent apertures within the array 74*a*, 74*b*, 74*c* by a distance of between about 0.3 and 1.5 cm, and preferably ranging from about 0.4 cm to 1.0 cm.

FIGS. 4 and 5A show the cover forward edge portion 52 as including an angularly upwardly extending web 80, a covering flange 82, and a hooked anchor edge portion 84. The web 80 is illustrated best in FIG. 4 projects upwardly from a front edge of the central portion 54 forwardly at an inclination angle of between about 20 and 80°, and preferably between about 40 and 60°. FIG. 4 illustrates the web 80 as preferably including a longitudinally extending array of spaced circular apertures 86 which substantially correspond in size and spacing to apertures 76.

The covering flange 82 projects forwardly from the upper edge of the web 80 in a generally horizontal (±10°) orientation. The covering flange 82 has a dimension selected so as to at least partially overlie in juxtaposed contact with at least part of the horizontal flange 40. Most preferably, the webs 62, 80 are provided with dimensions selected to position the central portion 54 generally horizontally, or sloping forwardly downward upto 15°, above the trough bottom 30 in an orientation spaced at between about 0.5 and 3 cm, preferably 1 to 2 cm, and most preferably about 1.5 cm, below the horizontal flange 40 when the cover 20 is secured in a mounted position over the gutter trough 16. The covering flange 82 is shown best in FIG. 2 as having a folded double wall construction, having flange layers provided in a flattened, inwardly forward orientation, and wherein the lower flange layer merges with the hooked edge portion 84 along its rearward most edge. Optionally, one or more pilot holes 83 may be formed through the covering flange 82. Preferably, the pilot holes 83 are provided at locations spaced towards each gutter cover 20 end, and are sized to assist in the gutter cover 20 in position over the rain gutter 16. The applicant has appreciated that by positioning the cover flange 82 over the horizontal flange 40, the angular orientation of the web 80 avoids the formation of pockets or recesses between the rain gutter 16 lip portion 34 and the forward portion 52 of the gutter cover 20. Rather, the upwardly sloping web 80 facilitates the deflection and movement of debris which accumulates on top of the gutter cover 20 off of and away from the gutter assembly 10.

The hooked anchor edge portion 84 most preferably extends angularly and forwardly downward in substantially the same angular orientation as the inner gutter lip 42 to a hooked end 96. The hooked end 96 of the hooked edge portion 84 is sized for mated engagement within the gutter end channel 44 to achieve an interlocked connection between the anchor edge portion 84 and gutter lip 42, when the covering flange 82 is moved over and against the horizontal flange 40.

The applicant has appreciated that with the flared orientation of the front web 62, tensioning screws 98 may optionally be used to provide increased mechanical interconnection between the cover 20 and the gutter trough 16. The insertion of tensioning screws 98 through the front web 62 and rear web 60 and into the facia board 12 results in the deflection of the forward edge and central portions 52, 54 of the rain gutter cover 20 moving rearwardly relative to the rain gutter 16 in the direction of arrow 100 shown in FIG. 5B. The rearward movement of the hooked end 96 into the channel 44 and relative positioning of the inner gutter cover 20 may effect more secure mechanical coupling of the cover 20 to the rain gutter 16 along its longitudinal length.

Figure 6:
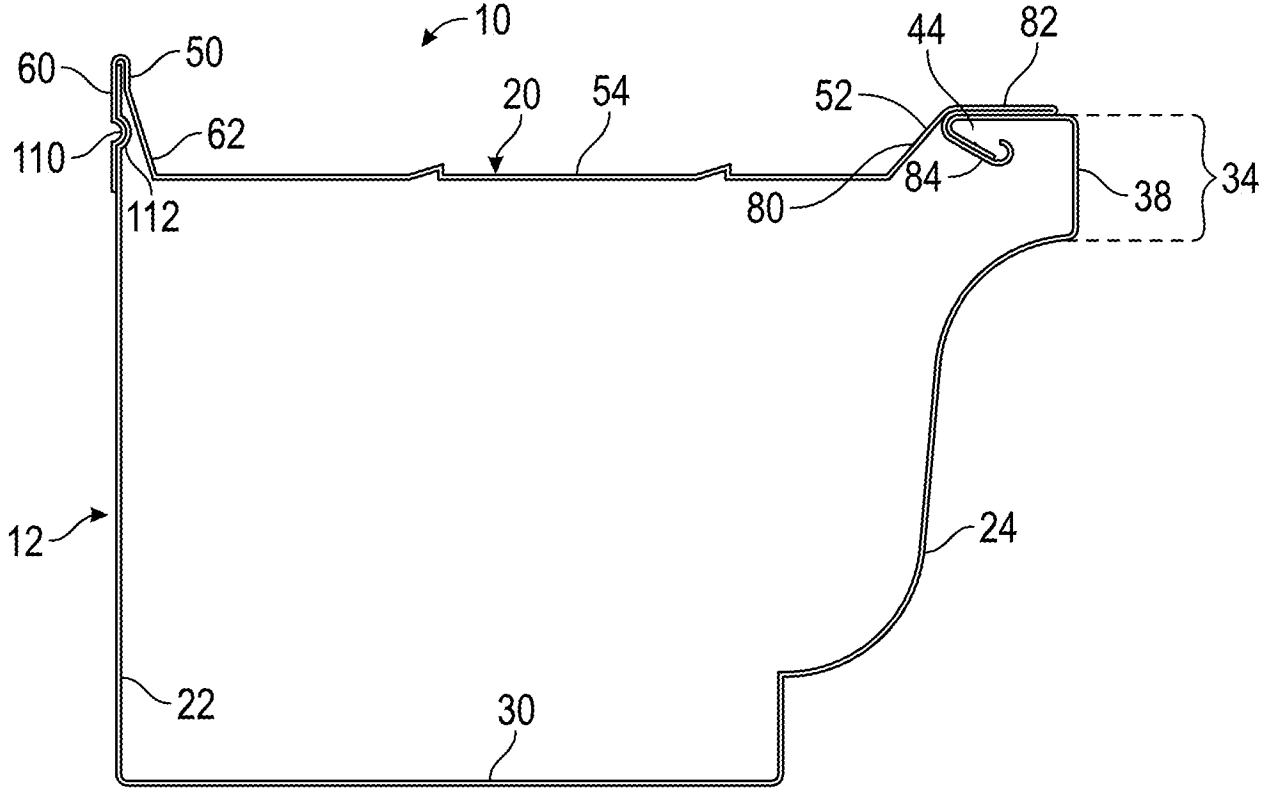
FIG. 6 shows a cross sectional view of a rain gutter assembly in accordance with a second embodiment of the invention.
Figure 7:
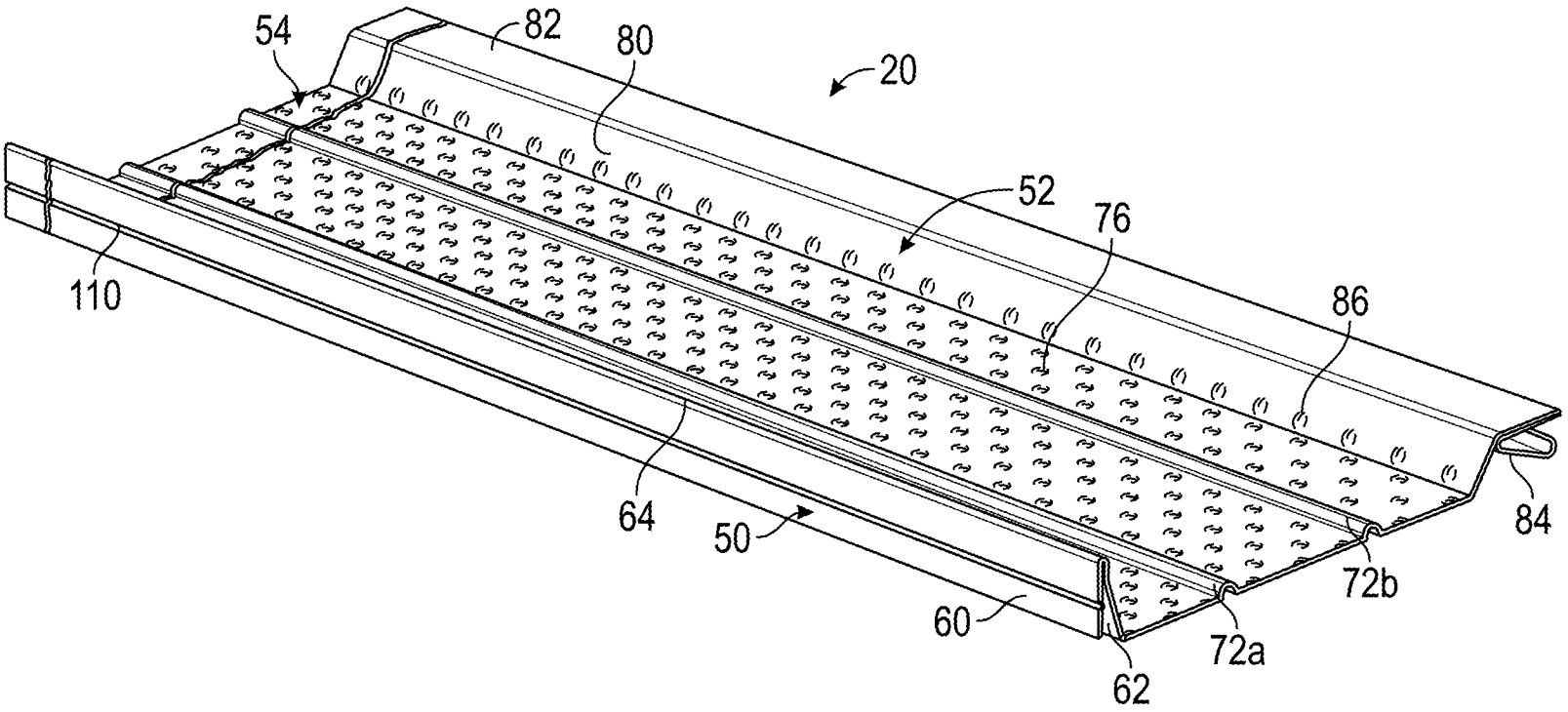
FIG. 7 illustrates a perspective top and rear view of the rain gutter cover shown in FIG. 6.
Figure 8:
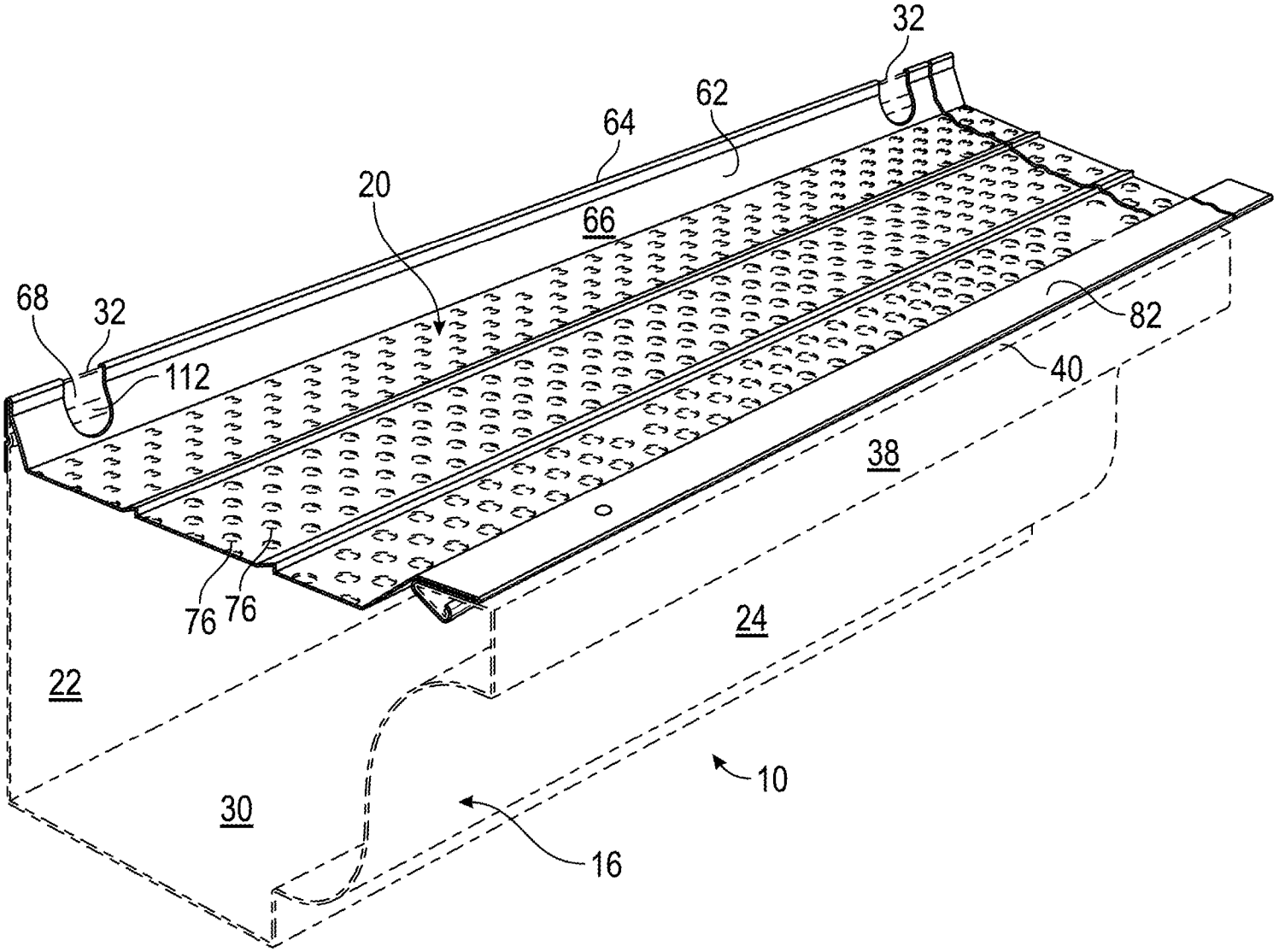
FIG. 8 illustrates schematically a perspective view showing the positioning of the rain gutter cover shown in FIG. 6.

Although the embodiment shown in FIG. 1 illustrates the rear portion 50 of the gutter cover 20 as having a substantially planar rear web 60, the invention is not so limited. Reference may be had to FIGS. 6 to 8 which illustrate a rain gutter assembly 10 and rain gutter 20 in accordance with a second embodiment of the invention, wherein like reference numerals are used to identify like components.

In the gutter assembly 10 shown in FIG. 6, the rear web 60 of the gutter cover 20 is provided with a longitudinally extending positioning rib 110. In particular, the positioning rib 110 is formed as a forwardly extending projection along a mid-portion of the rear web 60. The rear wall 22 of the rain gutter 16 is further provided with a longitudinally extending recess 112. The recess 112 has a size and is spaced from the top edge 32 of the rear wall 22 to receive the positioning rib 110 in a complementary fit arrangement, when the rear portion 50 of the gutter cover 20 is moved over the top edge 32. It is to be appreciated that the complementary engagement of the positioning rib 110 within the longitudinally recess 112 facilitates the mechanical securement of the gutter cover 20 in place over the rain gutter 16.

Figure 9:
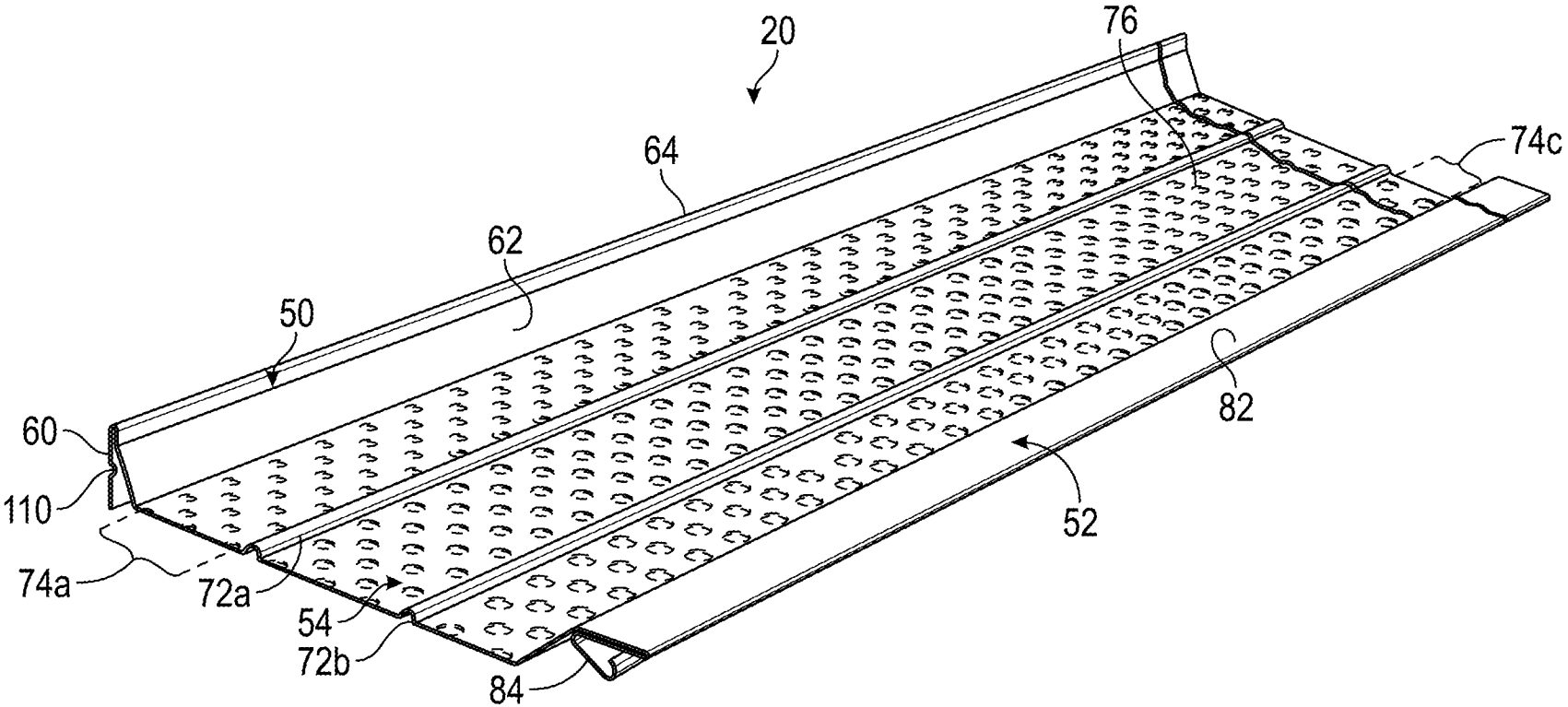
FIG. 9 illustrates schematically, a top and front perspective view of a rain gutter cover in accordance with a further embodiment of the invention.

Whilst the embodiment of the gutter cover 20 shown in FIG. 1 is described and illustrated as including a series of spaced cut outs 68, the invention is not so limited. Reference may be had to FIG. 9 which illustrates a gutter cover 20 in accordance with a further embodiment of the invention, and wherein like reference numerals are used to identify like components. In FIG. 9, the gutter cover 20 is provided with substantially the same configuration as the gutter cover in FIG. 1. The cover 20 is shown without spaced cut outs, and includes a positioning rib 110 configured for engagement with a longitudinal recess 112 formed in the rain gutter rear wall 22 in the manner of FIG. 8.

Although the detailed description describes the rain gutter 16 and rain gutter cover 20 as being formed from aluminum, the invention is not so limited. It is to be appreciated that the rain gutter 16 and/or the gutter cover 20 may be manufactured from a variety of materials including other metals such as copper, tin or their alloys, or from moulded plastics.

While the preferred embodiment of the invention describes the rain gutter 16 as a K-style rain gutter, the invention is not so limited. It is to be appreciated that the gutter cover 20 of the present invention is suitable for use with rain gutters having a number of different possible profiles or configurations.

FIGS. 3 and 4 illustrate the gutter cover 20 as having a series of generally U-shaped cut outs 68, the invention is not so limited. It is to be appreciated that cut outs of other geometric configurations and/or cut outs which extend entirely through the rear portion 50, rear web 60 and/or front web 62 may also be provided in accordance with the invention.

Although the detailed description describes circular apertures 76, 86, as being provided in the gutter cover 20 forward edge and central portions 52, 54, the invention is not so limited. It is to be appreciated that apertures of differing sizes, shapes and/or spacing may also be provided in the forward edge portion 52 and/or central portion 54 in greater or fewer numbers, in accordance with the present invention.

Although the detailed description describes and illustrates various preferred embodiments, the invention is not restricted to the specific constructions which are described. Many modifications and variations will now occur to persons skilled in the art.

I claim:

1. A gutter cover for use with a K-style rain gutter having a generally vertical rear gutter wall, substantially horizontal front gutter-flange portion spaced forwardly from said rear gutter wall, and a gutter lip extending forwardly downward from a rear of the horizontal front gutter-flange portion to define a channel therebetween, the gutter cover comprising, a generally U-shaped rear portion adapted for fitted placement over an upper edge portion of the rear gutter wall, the U-shaped rear portion including a vertically extending planar rear member and a front member spaced forwardly from the rear member and joined thereto along an uppermost bight, wherein the front member includes a vertical uppermost portion and planar lowermost portion extending angularly away from said vertically extending planar rear member, a forward edge portion, a perforated generally horizontal central portion spanning between said rear portion and said forward edge portion, and wherein the forward edge portion includes, a web extending upwardly from the central portion to a web upper edge, a covering flange extending horizontally forward from the web upper edge, and a hooked edge portion extending downwardly and forwardly from the web or the covering flange, the hooked edge portion having a hooked end, the hooked end being adapted for engaging contact with the gutter lip, the cover flange being sized for at least partial juxtaposed placement over at least part of the front gutter-flange portion when said hooked end is positioned in mechanical engagement with the gutter lip.

2. The gutter cover as claimed in claim 1, wherein the covering flange comprises a double wall flange having juxtaposed upper and lower flange layers, and wherein the hooked edge portion is integrally formed with the lower flange layer.

3. The gutter cover as claimed in claim 1, wherein the covering flange comprises a flattened double wall section in which said upper and lower layers are folded inwardly.

4. The gutter cover as claimed in claim 1, wherein the web extends angularly upwardly from said central portion at an inclination angle selected at between about 20° and 80°.

5. The gutter cover as claimed in claim 1, wherein said rear edge portion, said forward edge portion and said central portion are integrally formed.

6. The gutter cover as claimed in claim 1, wherein the perforated central portion includes at least one longitudinally extending reinforcing rib.

7. The gutter cover as claimed in claim 4, wherein the perforated central portion and the web include at least one array of circular apertures, each of the apertures having an average diameter selected at between 1 and 5 mm.

8. The gutter cover as claimed in claim 7, wherein the apertures are separated from each other by a distance selected at between about 0.3 cm and 1.5 cm.

9. The gutter cover as claimed in claim 1, wherein the rear portion includes a plurality of cut-outs, each said cut-out extending downwardly through said bight, part way through each of said rear member and said front member.

10. A gutter cover for use with a gutter trough having a trough rear gutter wall and trough front wall having a horizontal front gutter-flange portion and a gutter lip extending forwardly downward from a rear portion of the front gutter-flange portion to define a gutter end channel therebetween, the gutter cover comprising, a generally U-shaped rear portion adapted for fitted placement over an upper edge portion of the rear gutter wall, the U-shaped rear edge portion includes a rear member and a front member disposed forwardly from the rear member and joined thereto along an uppermost bight, wherein the front member includes an uppermost portion parallel to the rear member and a forward flaring planar lower-most portion extending angularly away from said rear member, a forward edge portion, a perforated generally horizontal central portion spanning between said rear portion and said forward portion, and wherein the forward edge portion includes, a web extending upwardly from the central portion to a web upper edge, a covering flange extending substantially horizontally forward from the web upper edge, and a hooked edge portion extending downwardly and forwardly from the flange, the hooked edge portion having a hooked end sized for positioning at least partially within the gutter end channel, when the covering flange is positioned in least partial juxtaposed placement over at least part of the front gutter-flange portion.

11. The gutter cover as claimed in claim 10, wherein the covering flange comprises a double wall flange having flattened upper and lower flange layers folded into substantially juxtaposed contact, and wherein the hooked edge portion is integrally formed with the lower flange layer.

12. The gutter cover as claimed in claim 10, wherein the covering flange comprises a flattened double wall section in which said upper and lower layers are folded inwardly, and wherein the hooked edge portion extends downwardly and forwardly to said hooked end at a substantially same angle as the gutter lip.

13. The gutter cover as claimed in claim 10, wherein the web extends forwardly and angularly upwardly from said central portion at an inclination angle selected at between about 20° and 80° from horizontal.

14. The gutter cover as claimed in claim 10, wherein said rear edge portion, said forward edge portion and said central portion are integrally formed from a single sheet of metal.

15. The gutter cover as claimed in claim 14, wherein the covering flange is provided without perforations.

16. The gutter cover as claimed in claim 15, wherein the perforated central portion includes at least one longitudinally extending reinforcing ribs.

17. The gutter cover as claimed in claim 15, wherein the perforated central portion includes at least one array of circular apertures, each of the apertures having an average diameter selected at between 1 and 5 mm.

18. The gutter cover as claimed in claim 17, wherein the apertures are separated from each other by a distance selected at between about 0.3 cm and 1.5 cm.

19. The gutter cover as claimed in claim 10, wherein the rear edge portion includes a plurality of cut-outs, each said cut-out extending downwardly from said bight, part way through said rear member and said front member.

20. In combination, a rain gutter trough and a gutter cover, the gutter trough having a laterally extending trough bottom, and spaced apart front and rear gutter walls projecting upwardly from opposing edge portions of said trough bottom, the front gutter wall including a generally horizontal upper flange portion, and a gutter lip extending forwardly downward from a rear edge of the upper flange portion to define a channel therebetween, the improvement wherein the gutter cover comprises, a generally U-shaped rear portion overlying an upper edge portion of the rear gutter wall, the U-shaped rear portion including a generally planar rear member and a front member disposed forwardly from the rear member and joined thereto along an uppermost bight, wherein the front member includes an uppermost portion parallel to the rear member and a forward flaring planar lower-most portion extending angularly away from said rear member, a forward edge portion, a perforated generally horizontal central portion extending laterally above the trough bottom from said rear portion to said forward edge portion, wherein the forward edge portion includes, an inclined web portion extending angularly upwardly from the central portion to a web upper edge at an inclination angle selected at between about 30° and 70°, a cover flange extending forwardly from the web upper edge, and a hooked lip portion projecting downwardly and forwardly below at least part of the cover flange, the hooked lip portion having a size and orientation selected for complementary mechanical engagement with the gutter lip, wherein the cover flange is juxtaposed over at least part of the front gutter-flange portion.

21. The combination as claimed in claim 20, wherein the covering flange comprises a double wall flange having juxtaposed upper and lower flange layers, and wherein the hooked edge portion is integrally formed with the lower flange layer.

22. The combination as claimed in claim 20, wherein the covering flange comprises a flattened double wall section in which said upper and lower layers are folded inwardly.

23. The combination as claimed in claim 21, wherein the hooked lip portion extends angularly downwardly from said lower flange at an inclination angle selected at between about 30° and 70°.

24. The combination as claimed in claim 23, wherein said rear edge portion, said forward edge portion and said central portion are integrally formed.

25. The combination as claimed in claim 24, wherein the perforated central portion includes at least one longitudinally extending reinforcing rib, the perforated central portion and the web include at least one array of circular apertures, each of the apertures having an average diameter selected at between 1 and 5 mm.

26. The combination as claimed in claim 25, wherein the apertures are separated from each other by a distance selected at between about 0.3 cm and 1.5 cm.

27. The gutter cover as claimed in claim 10, wherein the front member includes a forward flaring portion extending away from said rear member.

* * * * *